US008479473B2

(12) United States Patent
Gutierrez et al.

(10) Patent No.: US 8,479,473 B2
(45) Date of Patent: Jul. 9, 2013

(54) SUPPORTING ARCH STRUCTURE CONSTRUCTION METHOD

(75) Inventors: Eugenio Gutierrez, Besozzo (IT); Martin Poljansek, Cadrezzate (IT)

(73) Assignee: The European Union, Represented by the European Commission (BE)

( * ) Notice: Subject to any disclaimer, the term of this patent is extended or adjusted under 35 U.S.C. 154(b) by 0 days.

(21) Appl. No.: 13/318,984

(22) PCT Filed: Apr. 30, 2010

(86) PCT No.: PCT/EP2010/055937

§ 371 (c)(1),
(2), (4) Date: Jan. 10, 2012

(87) PCT Pub. No.: WO2010/128002

PCT Pub. Date: Nov. 11, 2010

(65) Prior Publication Data

US 2012/0096804 A1 Apr. 26, 2012

(30) Foreign Application Priority Data

May 6, 2009 (EP) ..... 09159584

(51) Int. Cl.

| | |
|---|---|
| ***E04B 1/00*** | (2006.01) |
| ***E04B 1/32*** | (2006.01) |
| ***E04G 21/00*** | (2006.01) |
| ***E04G 23/00*** | (2006.01) |

(52) U.S. Cl.
USPC ..... 52/742.1; 52/742.14; 52/745.07; 52/86

(58) Field of Classification Search
USPC ..... 52/745.05, 745.11, 745.14, 80.1, 52/86, 222, 223.1, 223.8, 64, 640, 646, 742.1, 52/742.13, 742.14, 745.07, 745.08, 745.13, 52/745.19, 745.2; 135/124, 125, 906
See application file for complete search history.

(56) References Cited

U.S. PATENT DOCUMENTS 2,415,240 A * 2/1947 Fouhy ..... 52/745.08
3,057,119 A * 10/1962 Kessler ..... 52/745.07

(Continued)

FOREIGN PATENT DOCUMENTS

DE 1139528 11/1962
GB 1202706 8/1970

(Continued)

OTHER PUBLICATIONS

International Search Report PCT/EP2010/055937; Dated May 3, 2011.

*Primary Examiner* — Andrew Triggs
(74) *Attorney, Agent, or Firm* — Cantor Colburn LLP

(57) ABSTRACT

In a method of constructing a supporting structure (e.g. of a bridge or the roof of a building) in arched form, an initially straight or pre-curved frame structure, having a first end and a second end opposite to the first end, is pivotally supported at the first and second ends, whereupon the first and second ends are pushed towards one another to achieve a displacement of the first and second ends relative to one another, where the reduction of the distance between the first and second ends causes them to pivot and the frame structure to progressively and flexibly bend, against its resiliency, into a final arched form, the displacement of the first and second ends relative to one another is chosen to amount to at least 1% of the initial distance between the first and second ends, where the first and second ends are then fixed relative to one another in their displaced position so as to preserve the final arched form of the frame structure.

19 Claims, 7 Drawing Sheets

U.S. PATENT DOCUMENTS

| | | | | | |
|---|---|---|---|---|---|
| 3,530,622 | A | * | 9/1970 | Cohen | 52/86 |
| 3,708,944 | A | * | 1/1973 | Miyake | 52/745.08 |
| 3,763,618 | A | * | 10/1973 | Bennett et al. | 52/745.07 |
| 3,849,953 | A | * | 11/1974 | Cohen | 52/86 |
| 3,857,213 | A | * | 12/1974 | Miyake | 52/86 |
| 3,899,854 | A | * | 8/1975 | Huddle | 52/81.2 |
| 3,909,993 | A | * | 10/1975 | Huddle | 52/63 |
| 4,065,906 | A | * | 1/1978 | Mears | 52/745.08 |
| 4,143,502 | A | * | 3/1979 | Wyche | 52/745.08 |
| 4,325,207 | A | * | 4/1982 | Russell et al. | 52/641 |
| 4,676,045 | A | * | 6/1987 | Ellen | 52/745.2 |
| 4,745,718 | A | * | 5/1988 | O'Sullivan et al. | 52/223.12 |
| 4,965,973 | A | * | 10/1990 | Engebretsen | 52/223.8 |
| 6,108,998 | A | | 8/2000 | Dumlao | |
| 6,128,864 | A | * | 10/2000 | Barry et al. | 52/86 |
| 6,170,105 | B1 | | 1/2001 | Doyle | |
| 6,455,131 | B2 | | 9/2002 | Lopez-Anido | |
| 2012/0096804 | A1 | * | 4/2012 | Gutierrez Tenreiro et al. | 52/742.14 |

FOREIGN PATENT DOCUMENTS

| | | | |
|---|---|---|---|
| GB | 1364900 | | 8/1974 |
| WO | 9013715 | A1 | 11/1990 |
| WO | 2007084803 | A2 | 7/2007 |

* cited by examiner

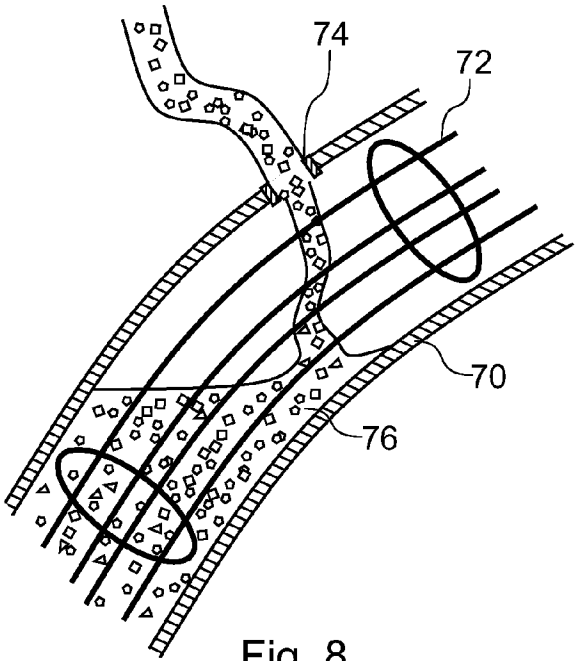
Fig. 8
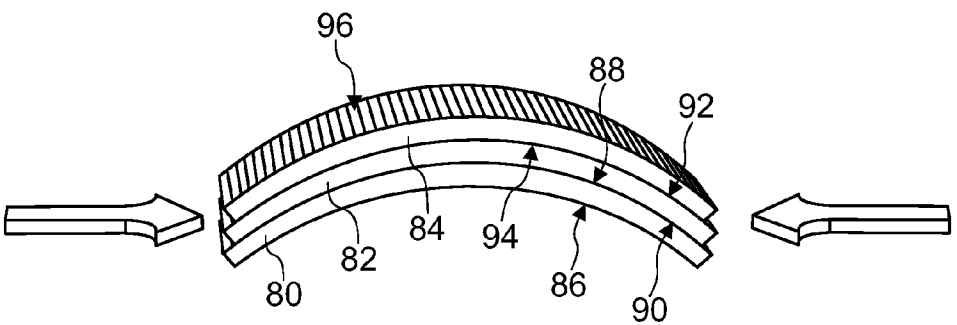
Fig. 9
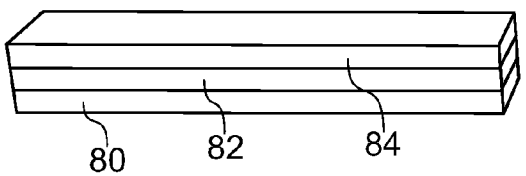

SUPPORTING ARCH STRUCTURE CONSTRUCTION METHOD

TECHNICAL FIELD

The present invention generally relates to a method of constructing a supporting architectural structure, or structural frame, having the form of an arch. The invention is generically applicable to arch structures in lattice or shell form, in which the main structural forces are resolved into compressive forces, in particular to arch bridges, (e.g. supported deck arch bridges, suspended deck arch bridges, tied arch bridges, etc.) to large arched buildings, tunnels, galleries and temporary supporting structures.

BACKGROUND

For the purposes of the present, the terms "supporting structure" and "structural frame" designate the load-resisting sub-system of a construction (architectural structure), i.e. the part of the construction that transfers and possibly absorbs the main load through interconnected structural components or members.

Supporting arch structures, in particular of arch bridges, belong to the oldest engineered forms of construction and have played a fundamental role in the development of all advanced societies. For many centuries, arch bridges were constructed from masonry, which conditioned the manner and methods of construction to such an extent that, even with the advent of the industrial revolution, the first iron bridges were constructed as arch (i.e. compressive load-carrying) structures. The introduction of modern materials permitted the adaptation of arch bridges for longer spans. The development of high-strength tensile steel in the twentieth century made it possible to construct arch bridges with spans of hundreds of meters especially by means of transferring the reaction forces away from the abutments to the bridge deck itself (tied arch bridges).

The traditional construction materials for structural components are concrete, steel and—nowadays to a lesser extent—wood. In the second half of the twentieth century, a new class of materials, fibre-reinforced polymers or plastics (FRP), slowly began to be considered as potential candidates as construction materials for addressing the limitations of concrete, wood and steel structures. These composite materials are most interesting for the construction industry due to their high strength, low weight and high corrosion resistance. Nevertheless, in spite of the continual reduction in their prime material cost, FRPs still remain relatively expensive in general, even when this handicap is offset on the long term by generally low life cycle cost.

The use of FRP in bridge construction has produced a number of interesting solutions for deck systems, described, for instance, in patents U.S. Pat. No. 6,108,998, U.S. Pat. No. 6,170,105 and U.S. Pat. No. 6,455,131. However, although the potential (in terms of their mechanical properties) for the use of FRPs materials in long-span bridges is very high, the current material prices and the lack of production methods capable of producing the large components at acceptable market prices has restricted the spreading of such materials in bridge construction, particularly for single spans in excess of ten meters. Although, in principle, the use of cheaper FRPs (such glass-fibre reinforced composites, GFRC) is an acceptable option for short spans or long pedestrian bridges, GFRCs have a rather low specific modulus which precludes them from use in stiffness-dominated bridge applications whenever spans in excess of a tens meters are called for. Of course, long bridges made from FRPs are viable if they are multiply supported; however, in certain locations, multiple supports are not always physically possible or are too expensive to implement. For these reasons, current construction and installation practice has only resulted in medium-length multi-span or short, single-span, beam bridges.

In civil engineering applications, there is a need for cost-efficient construction methods for erecting supporting structures, in particular with medium and long spans.

WO 90/13715 A1 discloses a method of constructing an arched building structure that uses lightweight elongate frames, pivotally connected to each other at one end, wherein the frames are lifted simultaneously so that the pivotal connection forms a ridge of the building structure. The free ends of the frames are anchored at abutments while the frames are held in the lifted position to form a three-pin arch frame building structure. U.S. Pat. No. 4,143,502 describes another method of constructing an arched building structure, wherein an elongate structural frame is bent into parabolic shape by lifting the medial portion thereof and fixing the opposed ends of the structural frame on abutments. When the ends are fixed, the flexed frame supports itself thanks to the abutments.

BRIEF SUMMARY to the invention provides an alternative cost-efficient construction method for erecting an arched supporting structure.

According to the invention, in a method of constructing a supporting structure (of an architectural construction such as e.g. a bridge or the roof of a building) in arched form, an initially straight or pre-curved frame structure, having a first end and a second end opposite to the first end, is pivotally supported at the first and second ends, whereupon the first and second ends are pushed towards one another to achieve a displacement of the first and second ends relative to one another. The reduction of the distance between the first and second ends causes them to pivot and the frame structure to progressively and flexibly bend, against its resiliency, into a final arched form. The displacement of the first and second ends relative to one another is chosen to amount to at least 1% of the initial distance between the first and second ends. The first and second ends are then fixed relative to one another in their displaced position so as to preserve the final arched form of the frame structure. The arched supporting structure is kept in place by suitable containments of the arch reaction forces, either at the abutments (or building foundations), or in case of a tied arch, by tension in a structural component (e.g. the deck in case of a tied arch bridge) linking the first and second end of the frame structure. An arched supporting structure erected according to the present method may be considered a "deployable" supporting structure in the sense that its constituent structural components generate an arch upon the application of a force provided by an actuated mechanism. The frame structure is preferably configured such that its bending takes place over substantially the entire length between the ends of the frame structure.

It should be noted that the term "frame structure", as used herein, is intended to cover, among others, a girder, a girder assembly, a beam, a beam assembly, or whichever structure that is to able to serve as a load-carrying structure when bent into an arched form as described above.

It should also be noted that the arched supporting structure achievable with the present invention might be part of the final construction or building. However, it is also possible that the supporting structure is only temporarily used during the construction stage, e.g. as a falsework.

According to a preferred variant of the method, there are at least two frame structures (hereinafter referred to as the first and second, possibly third, etc. frame structures), which are bent into arch shape. In this variant, each of the first and second frame structures comprises an extrados surface (i.e. a surface lying radially outward when the frame structure is bent) and an intrados surface (i.e. a surface lying radially inward when the frame structure is bent). The second frame structure is caused to progressively bend concomitantly with the first frame structure in such a way that one of the intrados and extrados surfaces of the first frame structure contacts the other of the intrados and extrados surfaces of the second frame structure at the latest when the first frame structure is in its final arched form. The second frame structure is then fixed to the first frame structure at the meeting surfaces so as to prevent relative movement between them. Such fixing of the second to the first frame structure is preferably achieved by gluing and/or with flanges. The second frame structure is preferably of the same configuration as the first frame structure. Accordingly, if reference is made hereinafter to a frame structure without that it is specified which one of the at least two frame structures is meant, the statement applies to any or all of the at least two frame structures, unless something different follows from the context. As those skilled will appreciate, by using relatively shallow frame structures, which are joined together, it is possible to reach significantly higher buckling capacities. On the other hand, by using a single frame structure having the dimensions of several shallow frame structures joined together, the material will fail much earlier for the bending strains at the intrados and/or extrados sides exceeding the tolerances.

According to a preferred embodiment of this variant of the invention, prior to bending, the first and second frame structures are arranged such that one of the intrados and extrados surfaces of the first frame structure is adjacent the other of the intrados and extrados surfaces of the second frame structure, a layer of glue being arranged between the adjacent surfaces. The progressive bending is carried out while the glue has not set so that the first and second frame structures are allowed to slide along their lengths while they bend. The fixing of the second frame structure to the first frame structure comprises letting the layer of glue set while keeping the first and second frame structures immobile with respect to one another when the first frame structure is in its final arched form.

According to a preferred embodiment of the method, the frame structure comprises fibre-reinforced polymer elements extending from the first end to the second end. Compared to other construction materials, FRPs exhibit very high strain-to-failure limits. In the case of glass-fibre-reinforced composites (GFRC) such FRPs come even with a competitive price. Those skilled will appreciate that other materials may be chosen, provided that such materials are able to withstand the considerable bending stresses occurring in the frame structure when it is bent into its arched shape. The FRP elements can be made using a variety of techniques, but the most attractive (and cheapest) solution is to use tubes or prismatic profiles that can be easily manufactured using filament-winding or pultrusion techniques, respectively. It is also possible to form the frame structure from sandwich panels, which are assembled flat on the construction site, cross-raced, and then bent into the desired curvature.

Experimental and analytical calculations have revealed that a curved FRP arch member would support working strain well in excess of the limits of steel or reinforced concrete members. For example, curved arch members made from FRP can be subject to an unloaded strain of the order of 0.2 to 0.3% just from the imposed curvature, whereas construction steel would yield at approximately 0.1% strain, making it impossible to generate the desired curvature without generating plastic deformations. It is expected that, under full load, the supporting structure could have a service strain of the order of 0.3 to 0.4% and a failure strain in excess of 1%, which is considered an adequate safety margin.

If a pre-curved frame structure is to be used, it could be made from a plurality of segments of uniform curvature fabricated by means of the same mould. The segments could be joined on the construction site to form the initially pre-curved frame structure. By using an initially arched frame structure, one may arrive at more pronounced arch heights than with an initially straight frame structure. It should be noted that the initial distance between the ends of the supporting structure would be measured along the straight segment between the ends (not along the initial arch).

Given that FRP supporting structures are, in principle, much lighter than such structures made from traditional materials like concrete, steel or wood, FRP supporting structures have the potential to substantially reduce construction costs and to be applicable to soil conditions where standard construction would otherwise require more extensive, and expensive, soil foundation.

Joining of FRP elements to form the frame structure could be carried out e.g. by using a vacuum-assisted resin-transfer moulding (VARTM) technique or in the case of profiles by connecting the pultruded profiles using standard joining techniques known to practitioners skilled in the art.

In a particularly advantageous variant of the invention, the frame structure is provided as a hollow fibre-reinforced polymer formwork for concrete or high-strength mortar. When the first and second ends are fixed relative to one another in their displaced position, concrete may be poured into the formwork. As the concrete sets, it increases the overall capacity and stability of the arched supporting structure. This variant addresses, in particular, applications in which the supporting structure has to carry high loads. There has been some concern over the safety of tied-arch bridges because the ties can be classified as fracture-critical members. A fracture-critical member is one that would cause collapse of the bridge if it fractured. Since its tie resists the horizontal thrust of a tied-arch, most tied arches would collapse if the tie were lost. One solution to mitigate the possibility of this type of collapse with the arch bridge system is to increase the overall capacity and stability of the arch by using e.g. hollow tubular elements as formwork that is filled with poured concrete. It should be noted that the formwork may remain in place after the concrete or mortar has set (in which case the resulting supporting structure comprises both the set concrete or mortar and the formwork), or, alternatively, be removed so as to leave only the concrete structure.

According to a preferred embodiment of this variant of the invention, the frame structure comprises steel and/or fibre-reinforced polymer rebar within the formwork. The formwork and the reinforcement placed therein, are subjected to bending at the same time. The reinforcement, being confined inside the formwork follows the curvature during the raising stage of the method. Once the arch has been erected and fixed, the formwork may be filled with concrete or high strength mortar. Again, the formwork may be removed after the concrete or mortar has cured, or remain in place.

The first and second ends are preferably pivotally supported about a first and a second pivot axis, respectively, these pivot axes being substantially parallel to one another and substantially perpendicular to the displacement of the first and second ends relative to one another. In such configuration, the bending of the frame structure takes place parallel to a plane that is perpendicular to the pivot axes. It should be noted that the pivot axes may be horizontal (resulting in a vertical arch) but may also be inclined with respect to the horizontal plane (in which case the arch will be inclined with respect to the vertical plane containing the first and second end of the frame structure). Preferably, the forces exerted on the first and second ends to push them towards one another are transferred to the frame structure via the pivot axes.

Preferably, the first end is pivotally supported by a first stationary swivel provided as part of a first abutment while the second end is pivotally supported with an actuatable swivel and pushing the first and second ends towards one another is carried out by the actuatable swivel pushing the second end and said stationary swivel exerting an opposite reaction force on the first end. Actuators suitable for actuating the actuatable swivel are e.g. actuators currently used in the push-forward bridge launching technique. Preferably, the actuatable swivel is guided on rails (fixed to the ground). When the second end has reached its desired position, the actuatable swivel is preferably fixed in a stationary position so as to become part of a second abutment, opposed to the first abutment.

Preferably, the displacement of the first and second ends relative to one another amounts to at least 2%, preferably at least 3%, more preferably at least 5%, possibly even at least 10% or at least 15%, of the initial distance between the first and second ends. Most preferably, the relative displacement amounts to around 5%, e.g. from 2% to 8% of the initial distance between the ends. To give an idea about the resulting arch heights, the following table summarizes the raise of the centre of the frame structure caused by such displacements of the ends relative to one another in case of an initially straight, horizontal frame structure in case of a perfectly parabolic shape when bent.

| Displacement in % of arch length | Arch height in % arch length |
|---|---|
| 1 | 6.12 |
| 2 | 8.65 |
| 3 | 10.59 |
| 5 | 13.65 |
| 10 | 19.24 |
| 15 | 23.46 |

Hence, given an initially straight, horizontal frame structure having a length of 100 m between the points of application of the compressive forces at the ends and assuming a perfectly parabolic shape of the resulting arch, a relative displacement of the ends toward one another of about 5 m will lift the centre of the frame structure by about 14 m. Of course, the flexibility of the material of the frame structure has to be chosen in accordance with the desired bending to avoid failure of the material.

BRIEF DESCRIPTION OF THE DRAWINGS

Further details and advantages of the present invention will be apparent from the following detailed description of several not limiting embodiments with reference to the attached drawings, wherein:

FIG. 8 is an illustration of the filling of an FRP formwork with concrete; and FIG. 9 is a schematic illustration of the bending of a layered assembly of plural frame structures into an arched form;

DETAILED DESCRIPTION

Figure 1:
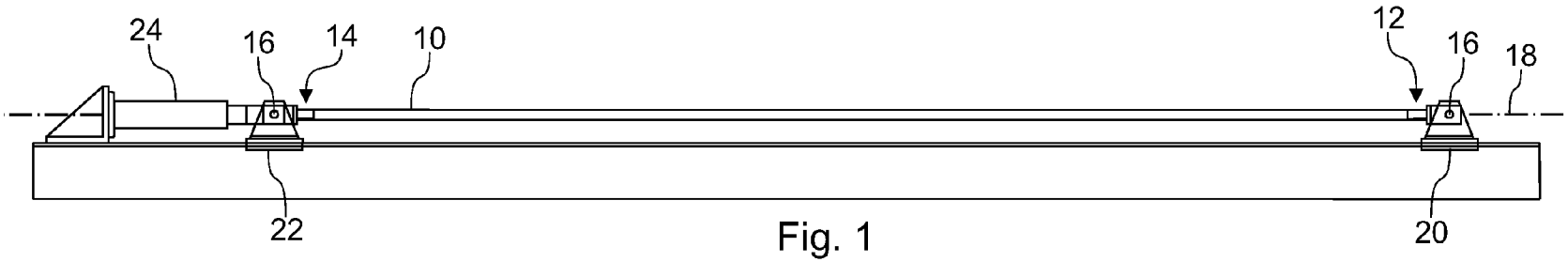
FIG. 1 is a lateral view of a straight beam before it is bent into an arched form.
Figure 2:
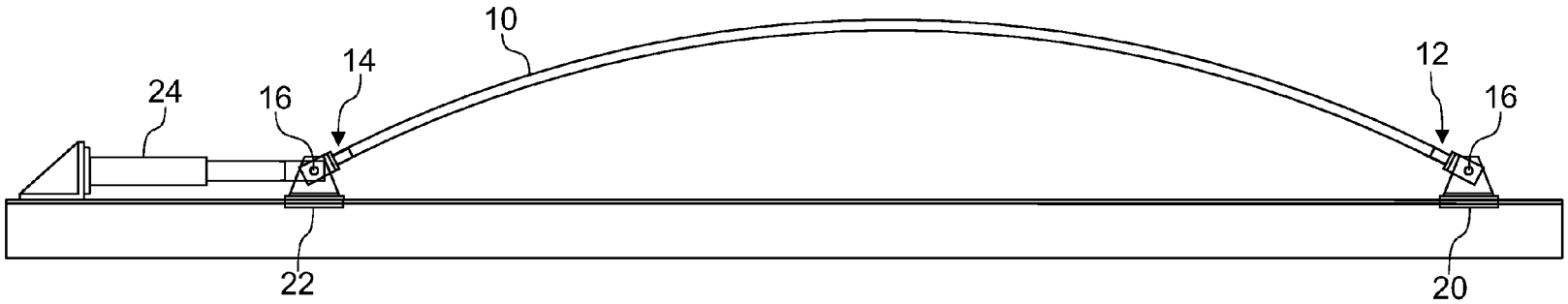
FIG. 2 is a lateral view of the beam of FIG. 1 when bent into the arched form.

FIGS. 1 and 2 illustrates the general concept underlying the method of constructing an arched supporting structure. An initially straight beam 10 of tubular (rectangular, round, trapezoidal or other) cross section is mounted pivotally supported at its ends 12, 14. The pivot axes 16 are parallel to one another and perpendicular to the longitudinal axis 18 of the beam. (FIGS. 1 and 2 show the longitudinal axis 18 and the pivot axes 16 to be horizontal; however, this is not necessary in general.) A stationary swivel 20 pivotally supports the first end 12 of the beam 10. The stationary swivel 20 is firmly anchored in the ground so as to form a first abutment of the arched supporting structure to be constructed. The second end 14 of the beam 10 is pivotally supported by a movable swivel 22, guided on rails (not shown in FIGS. 1 and 2) extending along the direction of the longitudinal axis 18 of the beam. An actuator 24 (e.g. a hydraulic or other actuator as commonly used in incremental bridge launching technique) is arranged to push the movable swivel 22 into the direction of the stationary swivel 20 at the first end 12 of the beam 10.

Before pushing the movable swivel 22, a small initial curvature (if not already present) is generated in the beam 10. The initial curvature is chosen such that the bending goes into the desired direction. When the actuator 24 pushes the movable swivel 22 into the direction of the stationary swivel 20 and thus the second end 14 towards the first end 12 of the beam 10, the distance between the ends 12, 14 decreases. As the beam length remains substantially the same, the beam 10 bends under the applied load and assumes an arched form. The distance between the first and second ends 12, 14 is measured between the pivot axes 16. The displacement of the first and second ends 12, 14 relative to one another is calculated beforehand, in accordance with the desired span and arch height and the static requirements. It is emphasized that the relative displacement of the ends 12, 14 is significant in the sense that it is not merely a displacement that leads to a pre-stressing of the beam 10, as commonly used e.g. on arched concrete structures to compensate for sagging moments, but one that results in a significant displacement of the beam centre off the longitudinal axis 18. In particular, the relative displacement of the ends amounts to at least 1% of the initial distance between the first and second ends 12, 14. The process of displacing the first and second end 12, 14 toward one another may be done in steps if the desired displacement is larger than the stroke length of the piston: the movable swivel 22 is then temporarily anchored in the ground or otherwise held in position, while the actuator 24 is brought closer. The next pushing step is then carried out essentially in the same way as the previous one after the movable swivel 22 has again been released.

When the desired arch curvature is reached, the movable swivel 22 is fixed in a stationary position relative to the swivel 20 at the other end of the beam 10. This may be achieved by fixing the movable swivel 22 to a previously prepared foundation, a socle or other support firmly anchored in the ground. Additionally or alternatively, the swivels 20, 22 may be tied to one another (as in case of a tied arch bridge) e.g. via a tie beam extending along the straight line between the ends of the arched beam. In case of a tied arch, the outward-directed horizontal forces of the arch, are at least partially borne as tension by the tie beam, rather than by the ground, the foundations or other supports the arched supporting structure rests upon.

The frame structure (in the above example: the tubular beam) is preferably made from fibre-reinforced polymer (FRP) elements, such as e.g. elements made of glass, carbon or aramid fibre reinforced composites, In the case of an arch being formed in the manner of the variant using intrados/extrados concommittant surfaces, it could also be possible to use high-strength aluminium or steel alloys or any material that could accommodate the bending strains.

Figure 3:
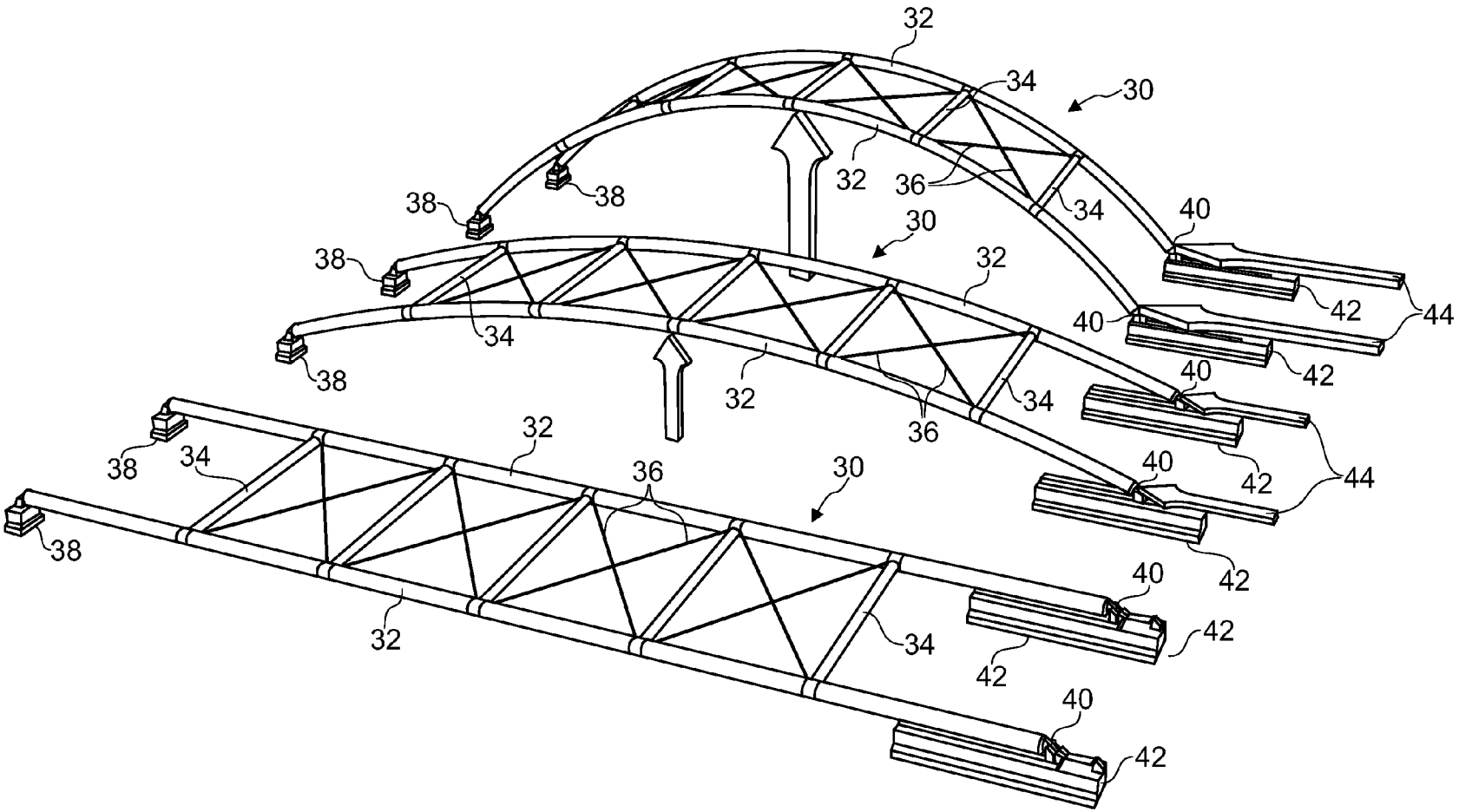
FIG. 3 is an illustration of the method according to the present invention applied to a braced structure.

FIG. 3 illustrates a variant of the method according to the invention, wherein the frame structure comprises a braced structure 30 with two initially straight longitudinal beams 32 arranged in parallel one to the other and a plurality of transverse beams 34 linking the longitudinal beams 32. The framework is completed by diagonal steel bars, rods, or cables 36, which make the framework more resistant against longitudinal shear stress. As the different views of FIG. 3 show, the frame structure is bent into arch shape in essentially the same way as the beam of FIGS. 1 and 2. The first end of each longitudinal beam 32 is pivotally mounted on a stationary swivel 38, whereas the second end of each longitudinal beam 32 is mounted on a movable swivel 40, guided on a rail 42. By progressively increasing the loads (illustrated by arrows 44) on the second end of each longitudinal beam 32, the initially slightly curved longitudinal beams 32 bend upwards until the frame structure finally reaches its planned curvature.

Instead of a tubular beam 10 as in FIGS. 1 and 2 or a braced structure 30 as in FIG. 3, the frame structure could also comprise a cutout panel or shell. The tubular elements of the longitudinal and transverse beams 32, 34 in FIG. 3 could be made using a filament winding process, or with arbitrary-shaped profile sections that could possibly be made using, for example, pultrusion techniques.

Figure 4:
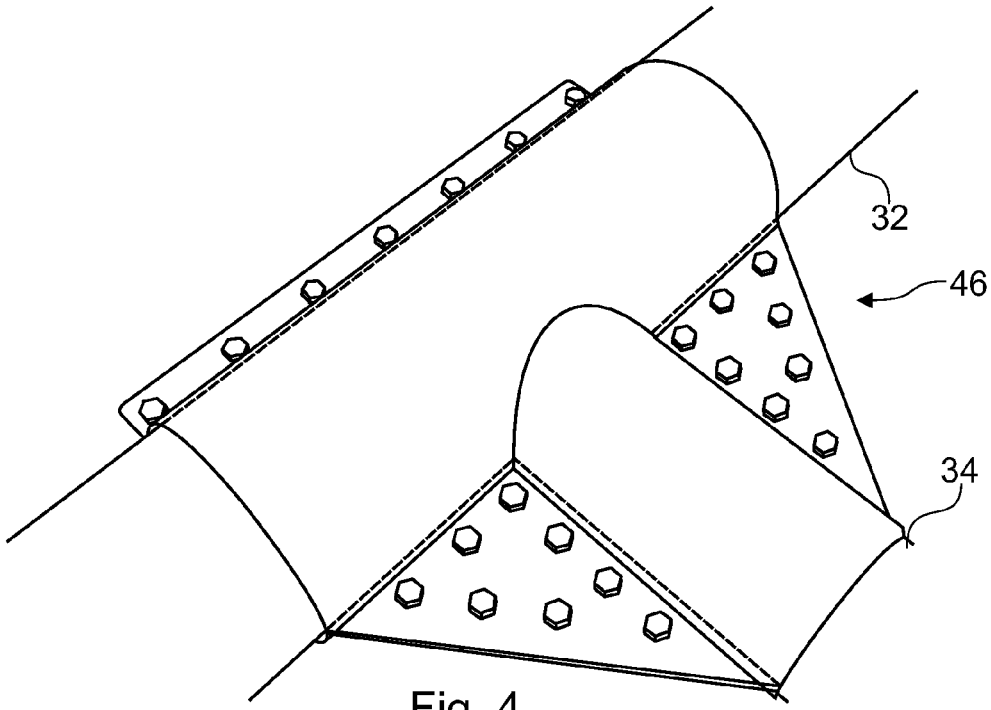
FIG. 4 is a perspective view close-up of a T-joint of the braced structure of FIG. 3.
Figure 5:
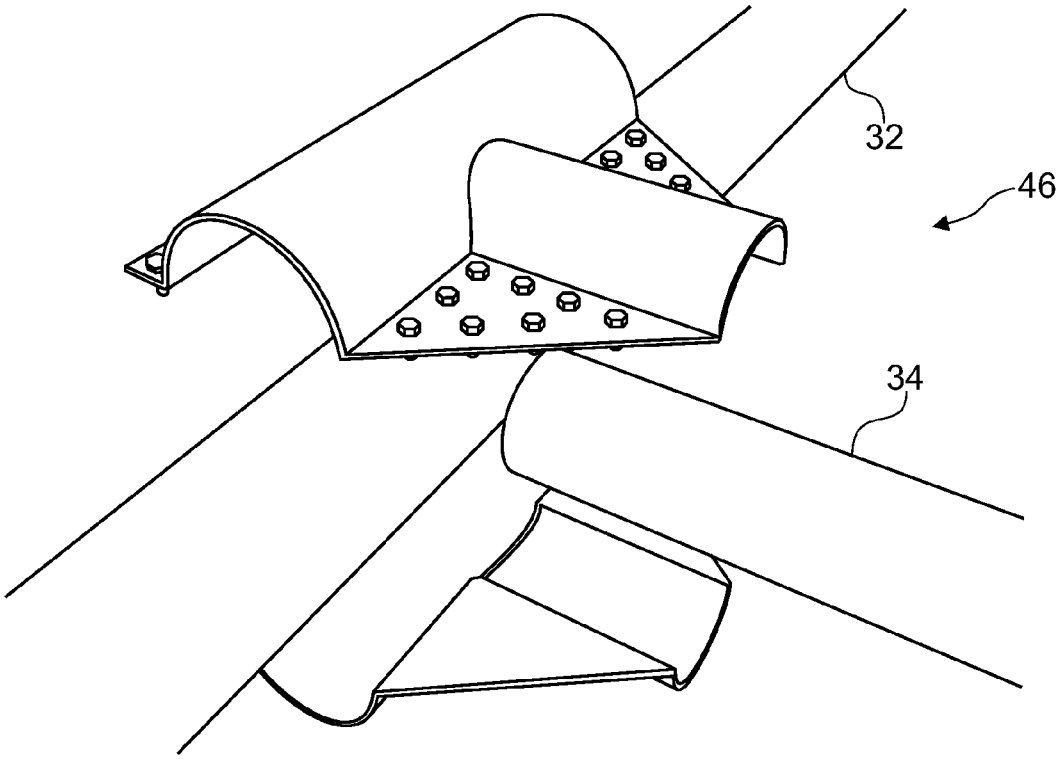
FIG. 5 is an exploded perspective view of the T-joint of FIG. 4.

Preferably, the beam elements are made to a length that is acceptable for transport and are joined on the construction site using, for example, vacuum-assisted resin transfer moulding or slot-in connectors 46 (as shown in FIGS. 4 and 5). In the case of the tubular beam elements being slotted into the T connectors, the structural strength of the resulting joint can be increased by applying adhesive between the overlapping surfaces of the connector elements and the beam elements. Once joined, the beam and connector elements form the flexible frame structure that is then placed over the span to be bridged and locked into abutments on either side.

Figure 6:
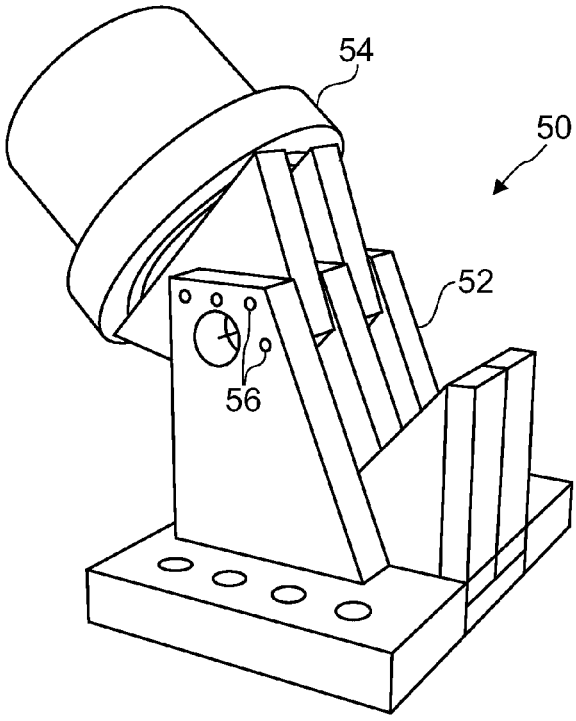
FIG. 6 is a perspective view of a swivel for fixing an end of the frame structure to be bent into arched form.

FIG. 6 shows an example of a swivel 50 for fixing the frame structure at its ends, usable as the stationary or the movable swivel. The swivel 50 comprises a base 52 and a sleeve portion 54, which is pivotally fixed to the base 52. The sleeve portion 54 is dimensioned such that the first or the second end of the supporting frame may be inserted into it. The base 52 is fixed to a foundation (if it is used as the stationary swivel) or a sliding train (if it is used as the actuatable swivel). Once the frame structure has reached the final curvature and required span, the rotation about the pivot axes of the first and second ends is fixed by blocking the sleeve portion 54 with linchpins 56 and the movable swivel is also fixed to a foundation, e.g. with bolts.

Figure 7:
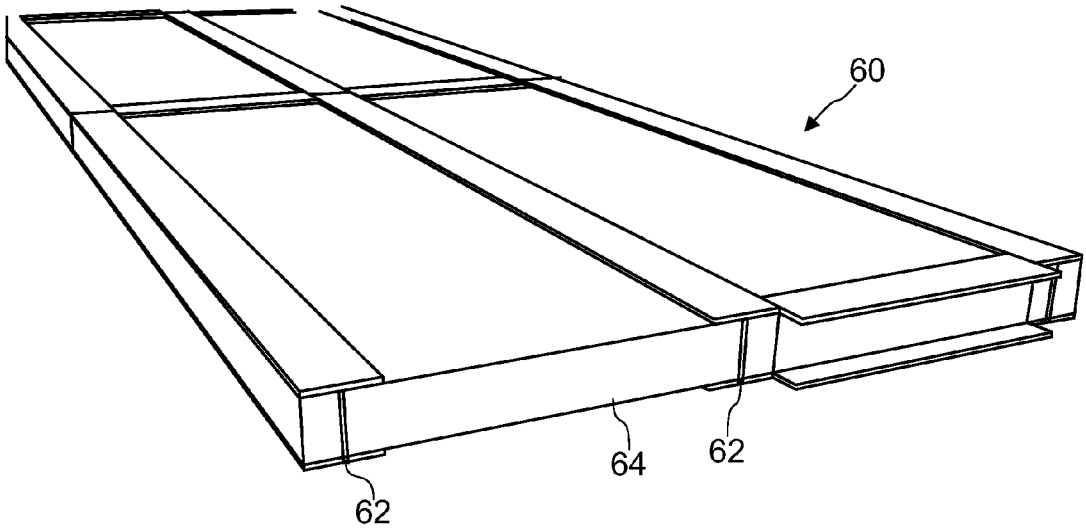
FIG. 7 is perspective view of a modular composite deck system made from FRP beams and slotted FRP sandwich panels.

FIG. 7 shows a modular composite deck assembly 60 made from FRP beams 62 and slotted FRP sandwich panels 64. When the supporting structure is in place, the deck assembly 60 may be suspended from it by means of cables. Another possibility is to suspend a light deck from the supporting structure before the latter is raised, so that when the arch forms, the deck is automatically lifted into position. Given that the buckling load of an arch depends non-linearly on arch curvature, the arch will initially only be capable of supporting a small fraction of the ultimate buckling load. Therefore, in this case the deck is preferably initially made from a light-weight composite box-beam, which is fitted with the heavy road-surface stratification once the final shape of the arch has been reached.

To increase the overall capacity and stability of the supporting structure, the support frame is preferably configured as a hollow formwork, into which concrete may be poured and allowed to set. Such a support frame is illustrated in FIG. 8. The support frame comprises tubular formwork elements 70 having arranged in their interior a steel or fibre-reinforced polymer rebar and stirrups 72. When the support frame is bent during the raising stage, the steel or FRP rebar 72 is forced to follow the curvature of the arch being generated. After the arch has been erected and fixed, the formwork is filled through openings 74, provided in the formwork shell, with concrete 76 or high-strength mortar. Once the concrete 76 or mortar has set, the supporting structure is capable of supporting much higher loads than before. To further enhance the capacity of the supporting structure, a hogging moment may be induced in the set concrete or mortar by a further displacement of the ends of the supporting structure towards one another. However, such further displacement would be much smaller than 1% of the initial distance between the ends because the concrete or mortar would fail otherwise. Filling the formwork with reinforced concrete could increase its buckling capacity by a factor of about 2 to 3, depending on the quality of the concrete or mortar used.

As shown in FIG. 9, it is also possible to compose the supporting structure from a plurality of sequential overlapping frame structures (e.g. flat tubes/profiles). Each of the frame structures has a relatively shallow section in the bending direction, so that the distance from the intrados and extrados surfaces to the respective neutral axis are small. Assume that one bends a square-section tube or profile with a height of 1 m in bending direction in such a way that the height-curvature imposes a strain of 3000 microstrain. If one bends a shallower tube or profile having a height of ⅓ m in bending direction to the same curvature, the resulting bending strains are approximately three times smaller. If three such shallow tubes or profiles 80, 82, 84 are placed on top of one another and bent up to the same arch height as the tube of 1 m height, whilst they are allowed to slide along their lengths as they rise up, the buckling capacity of the assembly would only be given by the individual shallow tube or profile sections (which is much smaller than the buckling capacity of the 1 m square section tube). If however, the shallow tubes or profiles are joined along their meeting surfaces after they have reached their final shape, the buckling capacity of the assembly becomes approximately the same as that of the 1 m square section tube or profile.

The shallow tubes or profiles have each an intrados surface and an extrados surface. As they are progressively bent concomitantly with one another, the intrados surfaces are compressed while the extrados surfaces are stretched, which locally results in relative movement between meeting surfaces, i.e. between the intrados surface 90 of the middle tube or profile and the extrados surface 88 of the lower tube or profile as well as between the extrados surface 92 of the middle tube or profile and the intrados surface 94 of the upper tube or profile. Once the tubes or profiles have reached their final positions, they are fixed to one another by gluing and/or with bolted flanges. Preferably, layers of glue are applied between adjacent meeting surfaces when the shallow tubes or profiles 80, 82, 84 still have their initial shape and the bending is carried out while the glue has not yet set and allows the meeting surfaces to locally slide one with respect to another while they bend. In this case, the layers of glue are simply let set while the shallow tubes or profiles 80, 82, 84 are kept immobile with respect to one another when they have reached their final arched form. Additionally, flanges may be used to bond and bolt the shallow tubes or profiles 80, 82, 84 together. Of course, the assembly of shallow tubes or profiles 80, 82, 84 might serve as a formwork for concrete or mortar, depending on the application.

Figure 10:
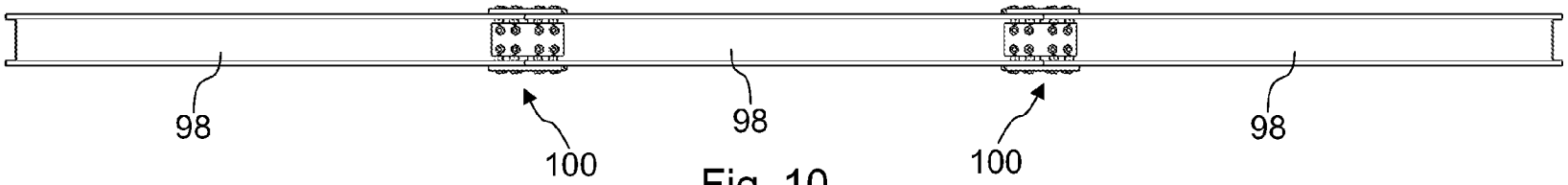
FIG. 10 is a side view of an FRP I-beam as may be used in a frame structure to be bent according to the invention.
Figure 11:
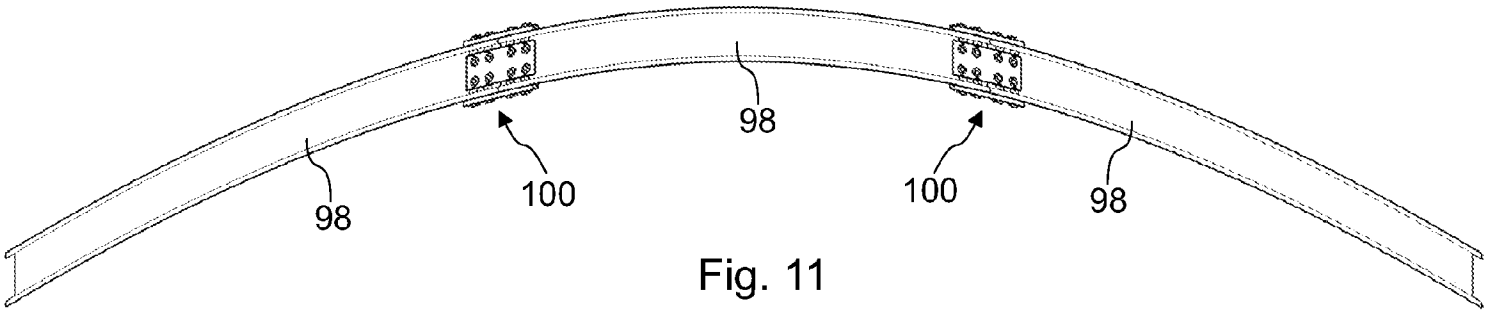
FIG. 11 is a side view of the I-beam of FIG. 10 when bent.
Figure 12:
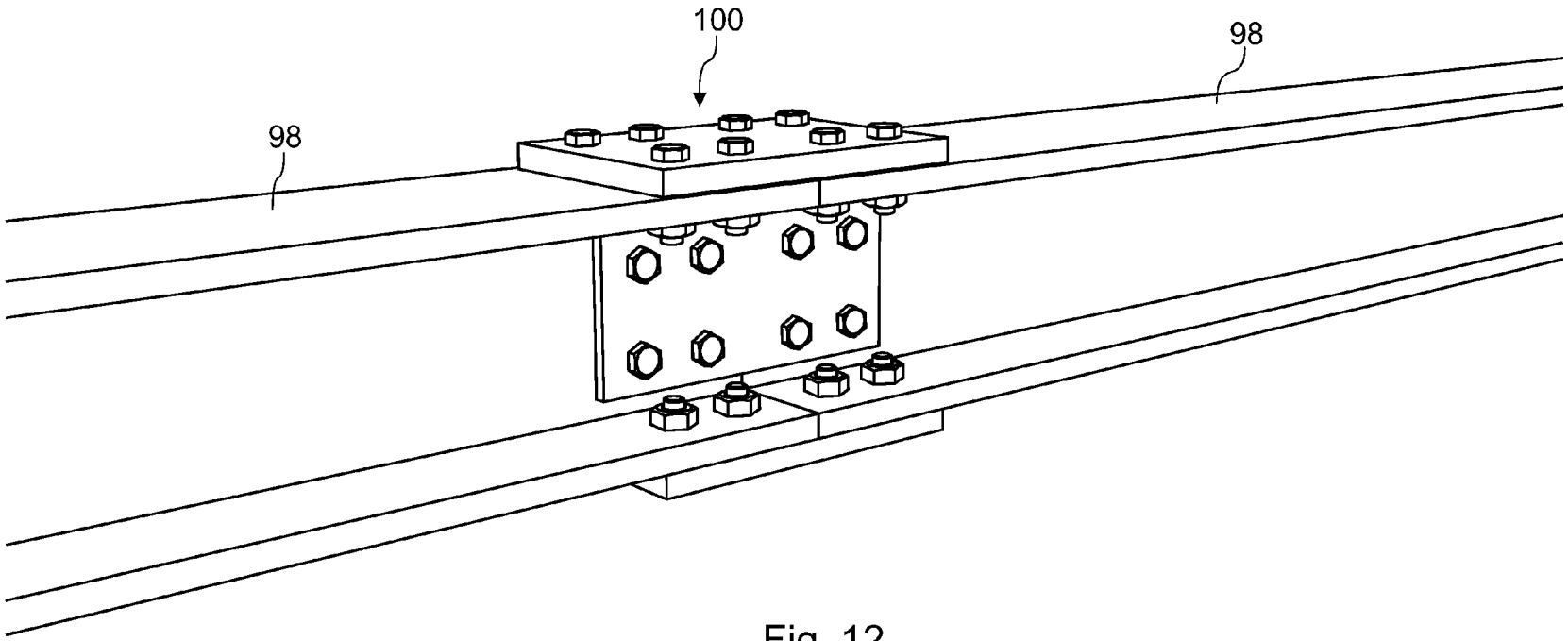
FIG. 12 is a perspective view of a bolted joint connecting two I-beam elements.

As illustrated in FIGS. 10-12, the frame structure to be bent into arch form according to the method of the present invention may be assembled from FRP I-beam elements 98 (sometimes also referred to as H- or double-T-beam elements), assembled together with bolted joints 100. The use of such profiles instead of hollow tubular profiles may be advantageous in case the frame structure of the construction needs not be filled with concrete or mortar.

The invention claimed is

1. Method of constructing a supporting structure in arched form, comprising:

providing an initially straight or pre-curved frame structure having a first end and a second end opposite to said first end, said first and second ends being separated from one another by an initial distance;

pivotally supporting said first and second ends;

pushing the first and second ends towards one another to achieve a displacement of said first and second ends relative to one another, thus causing the first and second ends to pivot and said frame structure to progressively and flexibly bend against a resiliency thereof into a final arched form, wherein the displacement of said first and second ends relative to one another amounts to at least 1% of the initial distance between said first and second ends; and fixing said first and second ends relative to one another in their displaced position so as to preserve the final arched form of said frame structure, wherein said frame structure comprises hollow tubular fiber-reinforced polymer elements extending from said first end to said second end and wherein concrete is poured into said hollow tubular fiber-reinforced elements, when said first and second ends are fixed relative to one another in their displaced position, said hollow tubular fiber-reinforced elements serving as formwork for said concrete.

2. The method according to claim 1, wherein said frame structure comprises at least one of steel and fiber-reinforced polymer rebar within said hollow tubular fiber-reinforced elements.

3. The method according to claim 1, wherein said first and second ends are pivotally supported about a first and a second pivot axis, respectively, said first and second pivot axes being substantially parallel to one another and substantially perpendicular to the displacement of said first and second ends relative to one another.

4. The method according to claim 1, wherein said pivotally supporting said first and second ends comprises pivotally supporting said first end with a first stationary swivel and pivotally supporting said second end with an actuatable swivel; and wherein pushing the first and second ends towards one another is carried out by said actuatable swivel pushing said second end and said stationary swivel exerting an opposite reaction force on said first end.

5. The method according to claim 4, wherein said actuatable swivel is guided on rails.

6. The method according to claim 4, wherein fixing said first and second ends relative to one another in their displaced position comprises fixing said actuatable swivel in a stationary position.

7. The method according to claim 1, wherein the displacement of said first and second ends relative to one another amounts to at least 2% or at least 15%, of the initial distance between said first and second ends.

8. The method according to claim 1, wherein said bending occurs substantially over the entire length between said first and second ends of said frame structure.

9. Method of constructing a supporting structure in arched form, comprising:

providing a first initially straight or pre-curved fiber-reinforced polymer frame structure having a first end and a second end opposite to said first end, said first and second ends being separated from one another by an initial distance;

pivotally supporting said first and second ends;

pushing the first and second ends towards one another to achieve a displacement of said first and second ends relative to one another, thus causing the first and second ends to pivot and said first fiber-reinforced polymer frame structure to progressively and flexibly bend against a resiliency thereof into a final arched form, wherein the displacement of said first and second ends relative to one another amounts to at least 1% of the initial distance between said first and second ends; and fixing said first and second ends relative to one another in their displaced position so as to preserve the final arched form of said first fiber-reinforced polymer frame structure, said method further comprising:

providing a second initially straight or pre-curved fiber-reinforced polymer frame structure, extending alongside the first frame structure, each of the first and second frame structures comprising an intrados surface and an extrados surface;

causing said second frame structure to progressively bend concomitantly with said first frame structure in such a way that one of the intrados and extrados surfaces of the first frame structure contacts the other of the intrados and extrados surfaces of the second frame structure at the latest when said first frame structure is in its final arched form; and fixing said second frame structure to said first frame structure so as to prevent relative movement between them.

10. The method according to claim 9, wherein said first and second frame structures are fixed to one another by at least one of gluing and with flanges.

11. The method according to claim 9, wherein said second frame structure is of the same configuration as said first frame structure.

12. The method according to claim 9, wherein prior to bending, said first and second frame structures are arranged such that one of the intrados and extrados surfaces of the first frame structure is adjacent the other of the intrados and extrados surfaces of the second frame structure, a layer of glue being arranged between the adjacent surfaces, wherein said progressive bending is carried out while said glue has not set so that the first and second frame structures are allowed to slide along their lengths while they bend and wherein said fixing said second frame structure to said first frame structure comprises letting said layer of glue set while keeping said first and second frame structures immobile with respect to one another when said first frame structure is in its final arched form.

13. The method according to claim 9, wherein said first frame structure and said second frame structure comprise hollow tubular fiber-reinforced polymer elements extending from said first end to said second end.

14. The method according to claim 9, wherein at least one of said first frame structure and said second frame structure comprises at least one of steel and fiber-reinforced polymer rebar within said hollow tubular fiber-reinforced polymer elements.

15. The method according to claim 9, wherein said first and second ends are pivotally supported about a first pivot axis and a second pivot axis, respectively, said first pivot axis being substantially parallel to and said second pivot axis and substantially perpendicular to the displacement of said first and second ends relative to one another.

16. The method according to claim 9, wherein said pivotally supporting said first and second ends comprises pivotally supporting said first end with a first stationary swivel and pivotally supporting said second end with an actuatable swivel; and wherein pushing the first and second ends towards one another is carried out by said actuatable swivel pushing said second end and said stationary swivel exerting an opposite reaction force on said first end.

17. The method according to claim 16, wherein said actuatable swivel is guided on rails.

18. The method according to claim 16, wherein fixing said first and second ends relative to one another in their displaced position comprises fixing said actuatable swivel in a stationary position.

19. The method according to claim 9, wherein the displacement of said first and second ends relative to one another amounts to at least 2% or at least 15% of the initial distance between said first and second ends.

* * * * *